US012247333B2

(12) United States Patent
Edward Vela

(10) Patent No.: US 12,247,333 B2
(45) Date of Patent: Mar. 11, 2025

(54) CROCHET ASSISTANCE APPARATUS

(71) Applicant: James Edward Vela, Maitland, FL (US)

(72) Inventor: James Edward Vela, Maitland, FL (US)

( * ) Notice: Subject to any disclaimer, the term of this patent is extended or adjusted under 35 U.S.C. 154(b) by 0 days.

(21) Appl. No.: 18/671,464

(22) Filed: May 22, 2024

(65) Prior Publication Data

US 2024/0401252 A1 Dec. 5, 2024

Related U.S. Application Data

(60) Provisional application No. 63/470,284, filed on Jun. 1, 2023.

(51) Int. Cl.

| | |
|---|---|
| ***D04B 33/00*** | (2006.01) |
| ***D04B 3/00*** | (2006.01) |
| ***D04B 3/04*** | (2006.01) |
| *D04B 31/00* | (2006.01) |

(52) U.S. Cl.

CPC ..... *D04B 33/00* (2013.01); *D04B 3/00* (2013.01); *D04B 3/04* (2013.01); *D04B 31/00* (2013.01)

(58) Field of Classification Search

CPC ... D04B 3/04; D04B 3/00; D04B 3/06; D04B 5/00; D04B 39/00; D04B 33/00; D04B 31/00

USPC ..... 66/1 R, 1 A, 3, 4

See application file for complete search history.

(56) References Cited

U.S. PATENT DOCUMENTS

| | | | | | |
|---|---|---|---|---|---|
| 248,669 | A | * | 10/1881 | Sackett | D04B 33/00 289/16.5 |
| 1,168,554 | A | * | 1/1916 | Riley | D04B 17/00 66/1 R |
| 2,072,668 | A | * | 3/1937 | Eltgroth | D04B 17/00 D15/66 |
| 3,717,012 | A | * | 2/1973 | Misner | D04C 3/00 66/1 A |
| 3,875,878 | A | * | 4/1975 | Kaminski | D05B 23/002 112/12 |
| 3,967,467 | A | * | 7/1976 | Leach, Sr. | D04B 3/00 66/4 |

(Continued)

FOREIGN PATENT DOCUMENTS

JP 2003171854 A * 6/2003

*Primary Examiner* — Danny Worrell

(74) *Attorney, Agent, or Firm* — PATENTFILE, LLC; Bradley C. Fach; Steven R. Kick

(57) ABSTRACT

A crochet assistance apparatus for supporting at least a portion of a flexible filament may include a first plurality of elongated projections and a second plurality of elongated projections, and may be movable between a first position and a second position. Each elongated projection of the first plurality of elongated projections may be proximate to the second plurality of elongated projections when the apparatus is in the first position, and one or more elongated projections of the first plurality of elongated projections may be moved out of being proximate to the second plurality of elongated projections when the apparatus is in the second position. A guide assembly may have a guide aperture that extends above both the first plurality of elongated projections and the second plurality of elongated projections. A tensioner assembly may be configured to receive and exert a resistance to the flexible filament moving through the tensioner assembly.

20 Claims, 8 Drawing Sheets

(56) References Cited

U.S. PATENT DOCUMENTS

| | | | | | |
|---|---|---|---|---|---|
| 4,193,273 | A * | 3/1980 | Palange | D04B 39/00 | 66/4 |
| 4,362,032 | A * | 12/1982 | Palange | D04B 39/00 | 66/4 |
| 4,393,668 | A * | 7/1983 | Leach, Sr. | D04B 5/00 | 66/4 |
| 4,635,834 | A * | 1/1987 | Lindquist | D04B 3/06 | 242/146 |
| 8,402,794 | B2 * | 3/2013 | Sasur | D04B 3/00 | 66/3 |
| 2012/0047960 | A1 * | 3/2012 | Sasur | D04B 3/00 | 66/1 A |
| 2016/0032500 | A1 * | 2/2016 | Novak | D04B 5/00 | 28/152 |

* cited by examiner

CROCHET ASSISTANCE APPARATUS

CROSS REFERENCE TO RELATED APPLICATIONS

This application claims priority to and the benefit of the filing date of U.S. Provisional Application No. 63/470,284, filed on Jun. 1, 2023, entitled "CROCHET ASSIST APPARATUS", which is hereby incorporated by reference in its entirety.

FIELD OF THE INVENTION

This patent specification relates to the field of crocheting yarn or other malleable filaments. More specifically, this patent specification relates to a crochet assistance apparatus which enables an individual with movement deficiency in a body part or extremity, e.g., fingers, hands, arms, shoulder, etc., to be able to crochet with pace and accuracy to make the activity enjoyable and fruitful.

BACKGROUND

Crocheting is a very specific art of manipulating yarn and other flexible filaments into various knotted patterns to produce a stretch of material which can be used for clothing, blankets, holders, cloth coverings, or any other product the imagination produces. The various knotted patterns are known as crochet stitches. A row is a series of numbered stitches. Once a crocheter reaches the end of the row, i.e., completes a desired number of stitches, some products are reversed, i.e., flipped direction, and the "next" row is started on the reverse side to create stitches that are unique to crocheting. Other products will continue in a contiguous line or circular pattern to create stitches that are unique to crocheting. This pattern is repeated until the desired number of rows is achieved. Crocheting differs from knitting and other yarn and flexible filament manipulating arts as crocheting is performed with two human hands, a bundle of yarn, and a crochet needle. Each hand has very specific tasks while crocheting. Because crocheting can be performed by either a "right" handed or "left" handed artist the terms "yarn hand" and "needle hand" will allow for ambidextrous nomenclature. This is not to imply that a crocheter could simply switch tasks between hands. Switching the yarn hand with the needle hand or vice versa is as practical as switching which hand one writes with. The needle hand holds a crochet needle, a long handheld cylindrical tool of various thickness with a hook at one end which will aid in manipulating the yarn or other malleable filament into various knotted patterns. The yarn hand provides structure, support, and guidance from the bundle of yarn to the completed product. The yarn hand must provide exacting structure, support, and guidance by fashioning the human fingers into various structures. These various structures require agility, dexterity, stamina, and proper human hand/finger placement knowledge to create the knotted patterns at a pace which makes crocheting an enjoyable task. The yarn hand must 1) hold the completed structure in a usable position, 2) provide support of the yarn for the needle to penetrate the next stitch, and 3) provide yarn guidance so the needle may have the appropriate approach for attack.

Due to illness, injury, or other maladies, one may find their ability to use their needle hand or their yarn hand diminished. At current, there are obvious and existing techniques that will aid those with needle hand deficiencies. Using a simple heavy structure in which a crochet needle is fastened, the artist will use the yarn hand to manipulate the yarn around the statically held needle.

There does not exist an aid, apparatus, structure, or technique that can help those with yarn hand deficiencies. The complexity of tasks the yarn hand must perform simultaneously requires an apparatus that provides 1) structure, 2) support, and 3) guidance with an easy-to-use interface. Beginning crocheters have a steep learning curve to develop the agility, dexterity, stamina, and proper hand/finger placement knowledge of their yarn hand to properly crochet with ease and enjoyment. Existing crocheters may see a decrease in agility, dexterity, or stamina in their hands over time. This is an effort to allow new and existing crocheters the ability to begin or continue their desire to crochet for whatever reason they may have.

My mother, Leticia, is left side hemiplegic due to a stroke and lost the ability to crochet, among other activities. My mother lost one-hundred percent ability to use her yarn hand. My mother has a longing towards enjoying this art again to some degree. I promised her I would attempt to create a device that could help her. I taught myself how to crochet and this device is an effort to allow my mother and others to gain some independence and enjoyment in this art lost to illness, injury, or other maladies.

Therefore, a need exists for novel crochet assistance apparatuses. A further need exists for novel crochet assistance apparatuses which enables a user to crochet and perform like activities to gain some independence and enjoyment in this art that may have been otherwise lost to illness, injury, or other maladies.

BRIEF SUMMARY OF THE INVENTION

A crochet assistance apparatus for supporting a flexible filament is provided which enables a user to crochet and perform like activities to gain some independence and enjoyment in this art that may have been otherwise lost to illness, injury, or other maladies.

In some embodiments, the apparatus may include a first plurality of elongated projections and a second plurality of elongated projections. The apparatus may be movable between a first position and a second position. Each elongated projection of the first plurality of elongated projections may be proximate to the second plurality of elongated projections when the apparatus is in the first position, and one or more elongated projections of the first plurality of elongated projections may be moved out of being proximate to the second plurality of elongated projections when the apparatus is in the second position. The apparatus may include a guide assembly having a guide aperture that extends above both the first plurality of elongated projections and the second plurality of elongated projections. The apparatus may include a tensioner assembly that may be configured to receive the flexible filament. The tensioner assembly may have a first filament contact surface, a second filament contact surface, and a third filament contact surface, and the tensioner assembly may exert a resistance to the flexible filament moving through the tensioner assembly.

In use, a flexible filament may be moved through the tensioner assembly, through the guide aperture, and into contact with the first and second plurality of elongated projections. The first and second plurality of elongated projections may provide support and positioning of the flexible filament as a crochet needle penetrates the working stitch to allow the user to generate a row of a desired number of stitches. The guide assembly functions to keep the portion of flexible filament that is progressing towards the first and second plurality of elongated projections above and out of the way of the user's needle hand, while the tensioner assembly maintains a desired resistance or tension to the flexible filament's movement to generate an appropriate amount of tension for the attacking needle.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
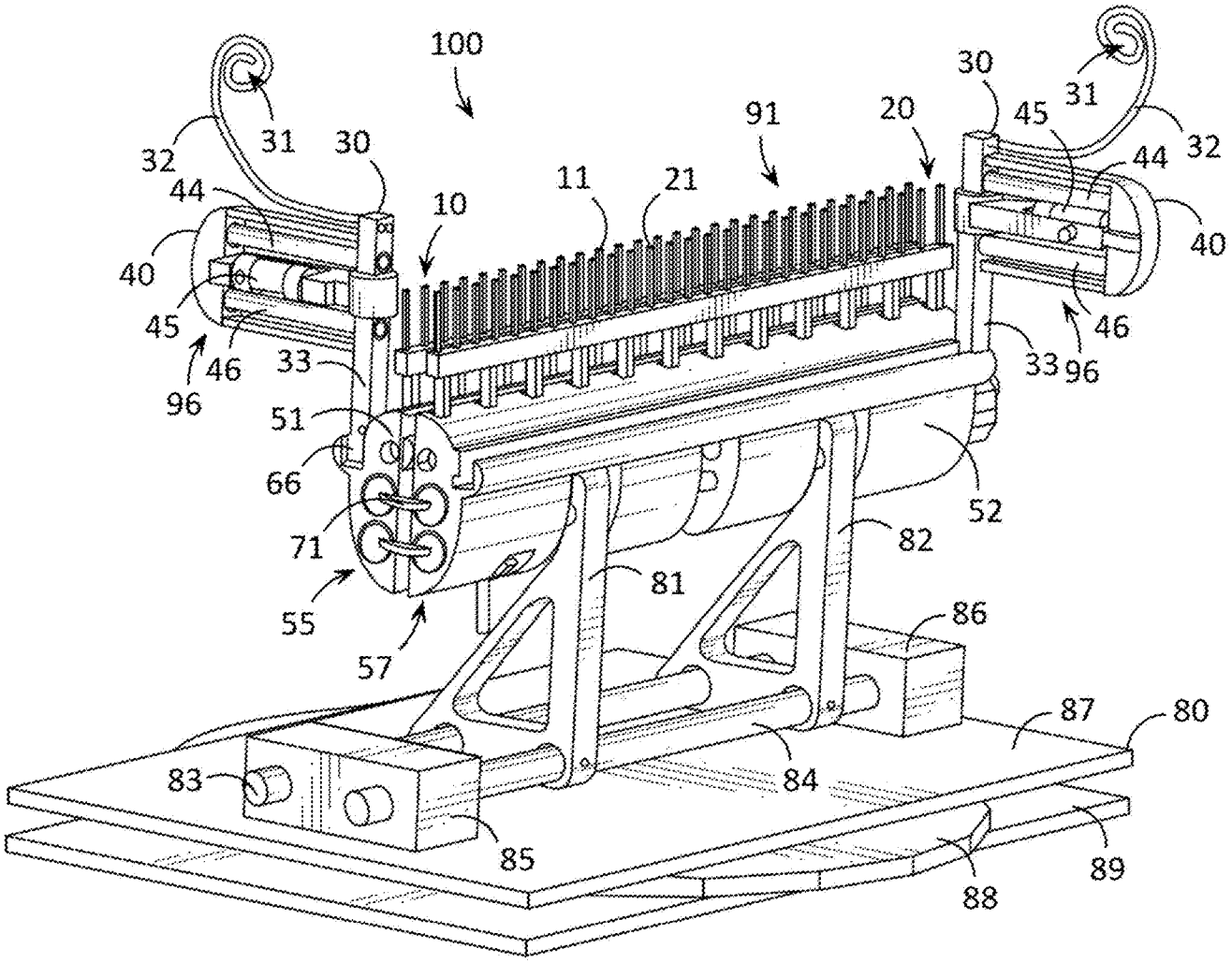
FIG. 1—FIG. 1 depicts a top rear perspective view of an example of a crochet assistance apparatus in a first or closed position according to various embodiments described herein.
Figure 2:
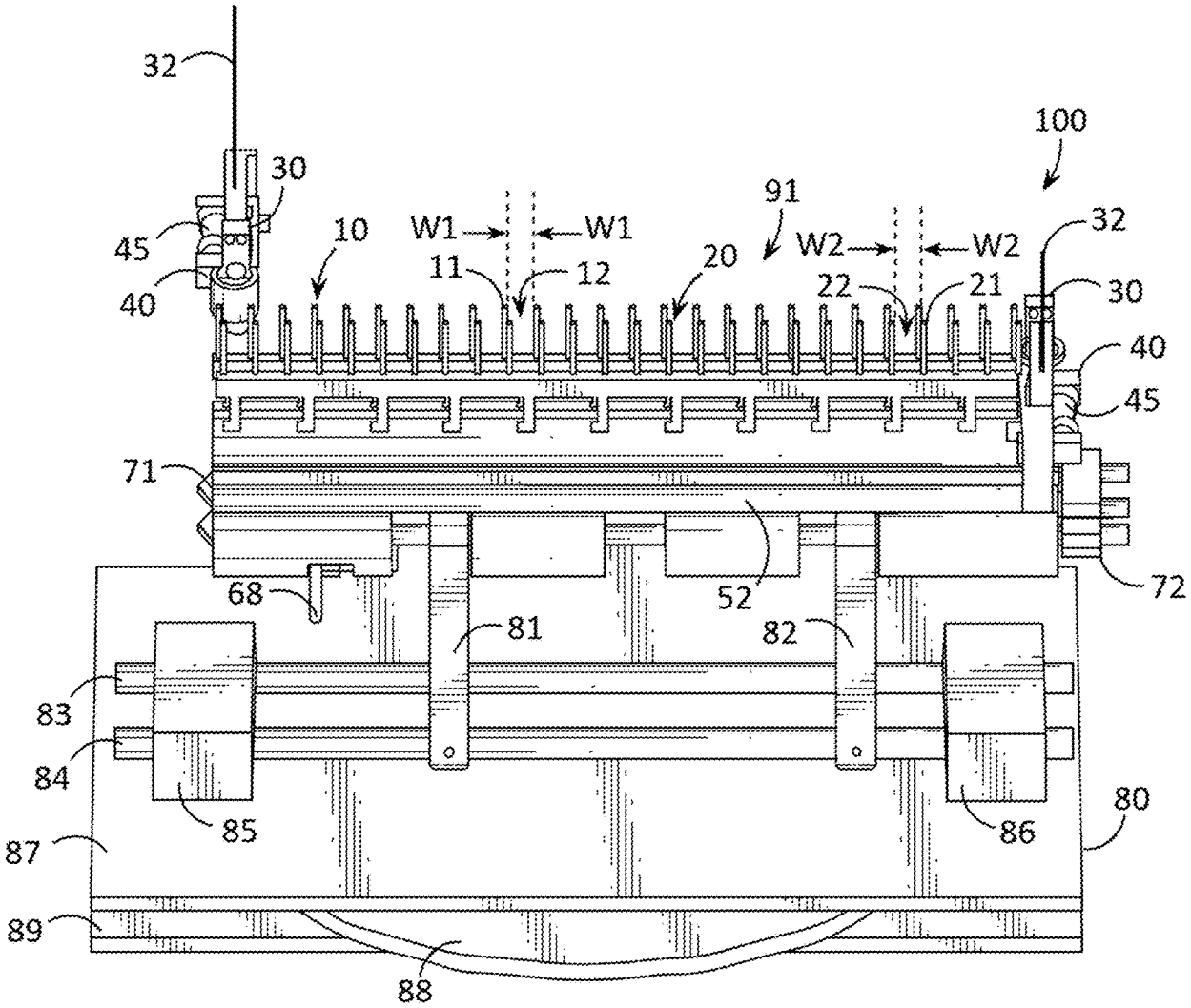
FIG. 2—FIG. 2 illustrates another top rear perspective view of an example of a crochet assistance apparatus in a first position according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 20% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new crochet assistance apparatus is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

Figure 3:
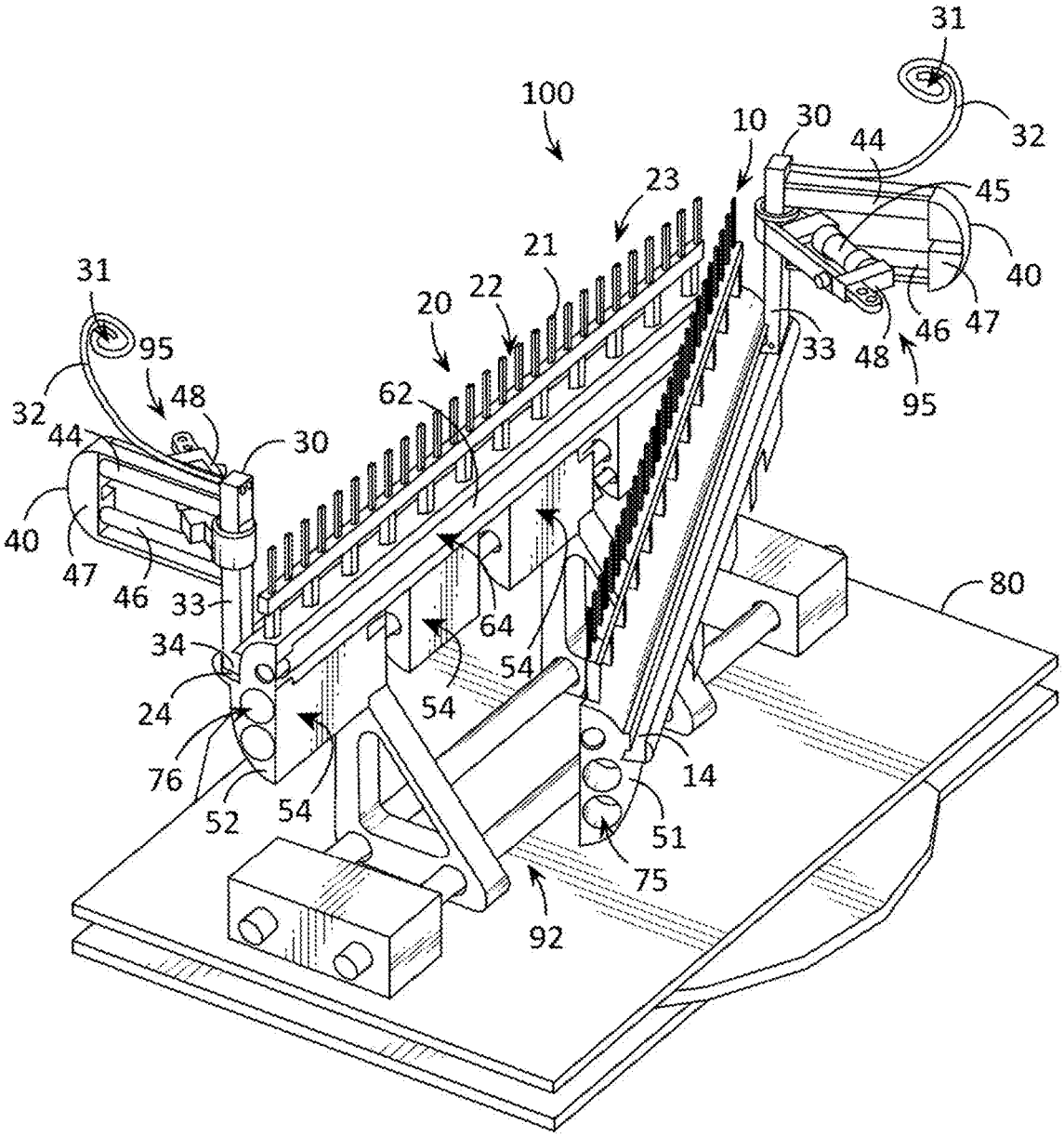
FIG. 3—FIG. 3 shows a top front perspective view of an example of a crochet assistance apparatus in a second or open position according to various embodiments described herein.
Figure 4:
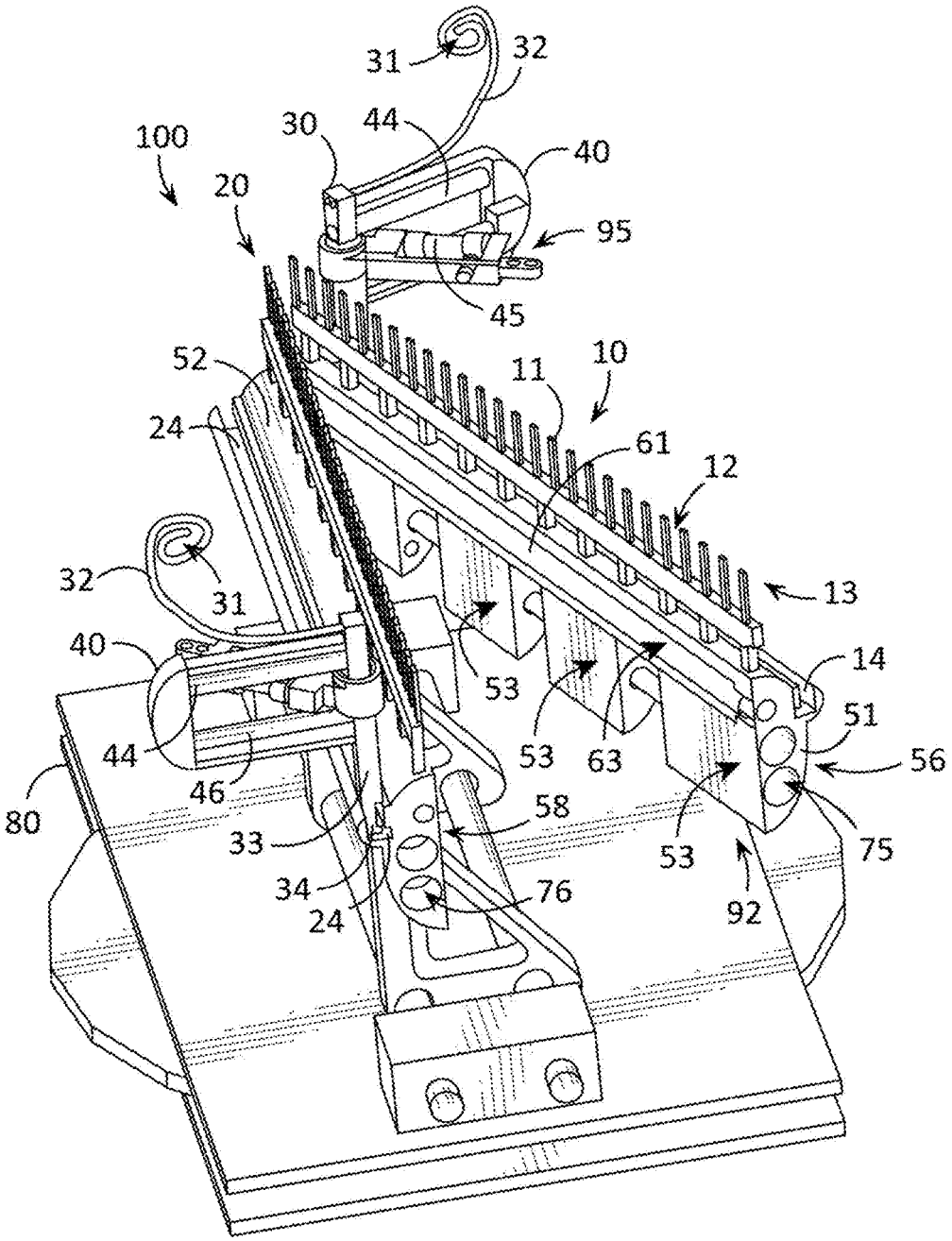
FIG. 4—FIG. 4 depicts a top rear perspective view of an example of a crochet assistance apparatus in a second position according to various embodiments described herein.
Figure 5:
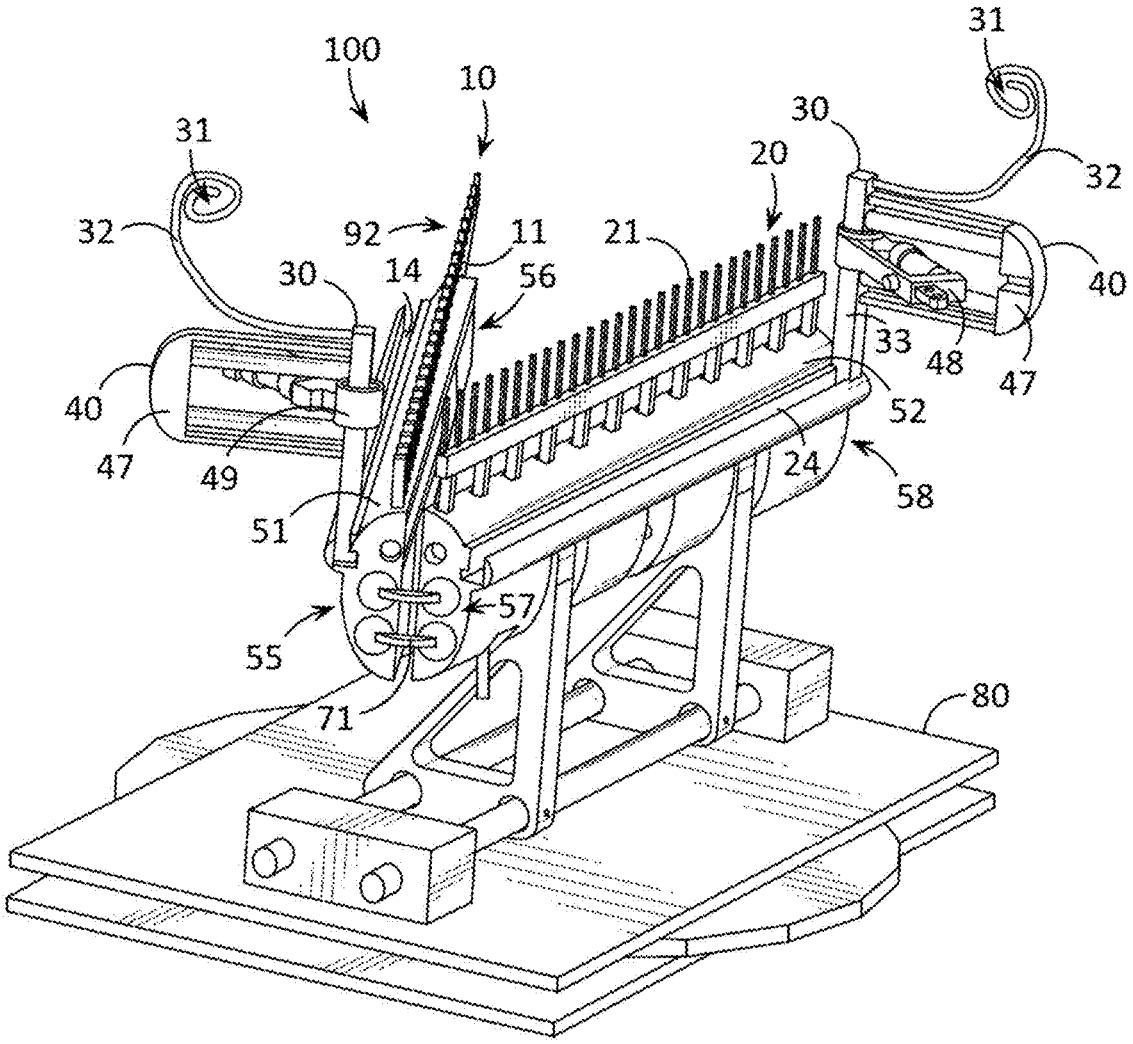
FIG. 5—FIG. 5 illustrates another top rear perspective view of an example of a crochet assistance apparatus in a second position according to various embodiments described herein.

The present invention will now be described by example and through referencing the appended figures representing preferred and alternative embodiments. FIGS. 1-7 illustrate an example of a crochet assistance apparatus ("the apparatus") 100 according to various embodiments. The apparatus 100 may be used to support a flexible filament 200 to facilitate a user's ability to manipulate the flexible filament 200, such as for performing crochet activities. Preferably, the apparatus 100 may perform one or more, such as all, the functions of a user's "yarn hand" during the performance of crochet and other flexible filament 200 manipulating activities. In some embodiments, the apparatus 100 may comprise a first plurality of elongated projections 10, a second plurality of elongated projections 20, a guide assembly 30, and a tensioner assembly 40. The apparatus 100 may be movable between a first position 91 (FIGS. 1, 2, 6, and 7) and a second position 92 (FIGS. 3-5). When the apparatus 100 is in the first position 91, the first plurality of elongated projections 10 and the second plurality of elongated projections 20 may be relatively closer together, and when the apparatus 100 is in the second position 92, the first plurality of elongated projections 10 and the second plurality of elongated projections 20 may be relatively farther apart. The guide assembly 30 may include a guide aperture 31 that extends above both the first plurality of elongated projections 10 and the second plurality of elongated projections 20. The tensioner assembly 40 may be configured to receive the flexible filament 200, so that the flexible filament 200 moves through the tensioner assembly 40 and contacts one or more elements of the tensioner assembly 40. The tensioner assembly 40 may have a first filament contact surface 41, a second filament contact surface 42, and a third filament contact surface 43, and the tensioner assembly 40 may exert a resistance or tension to the flexible filament 200 moving through the tensioner assembly 40. In use, a flexible filament 200 may be moved through the tensioner assembly 40, through the guide aperture 31, and into contact with the first 10 and second 20 plurality of elongated projections. The first 10 and second 20 plurality of elongated projections may provide support and positioning of the flexible filament 200 as a crochet needle 300 penetrates the working stitch to allow the user to generate a row of a desired number of stitches. The guide assembly 30 functions to keep the flexible filament 200 that is progressing towards the first 10 and second 20 plurality of elongated projections above and out of the way of the user's needle hand 400, while the tensioner assembly 40 maintains a desired resistance or tension to the flexible filament's 200 movement to generate an appropriate amount of tension for the attacking needle 300.

The apparatus 100 may comprise a first plurality of elongated projections 10 that may be made up of any number of individual elongated projections 11, such as between five and 500 individual elongated projections 11. Similarly, the apparatus 100 may comprise a second plurality of elongated projections 20 that may be made up of any number of individual elongated projections 21, such as between five and 500 individual elongated projections 21. Generally, the first plurality of elongated projections 10 and the second plurality of elongated projections 20 may be used to provide backing support for the working stitch of a working product 201 and may replace or function as one or more of the users the fingers that hold the working stitch in place while the needle 300 manipulates the yarn or flexible filament 200. For example, the first plurality of elongated projections 10 and the second plurality of elongated projections 20 may each comprise a series of outstretched rubberized, flexible, yet firm, elongated nodules that allow the attacking needle 300 unfettered access to the working stitch.

Elongated projections 11, 21, may have an elongated shape, having a height dimension that may be substantially greater than their width and length dimensions. Preferably, elongated projections 11, 21, may have a height dimension of between 0.2 inches and 2.0 inches, and more preferably a height dimension of between 0.5 inches and 1.0 inches. In some embodiments, elongated projections 11, 21, may comprise an elongated cylindrical shape, an elongated rectangular prism shape, an elongated triangular prism shape, an elongated hexagonal prism shape, etc. It should be understood that elongated projections 11, 21, may be configured in any shape and size.

In some embodiments, one or more elongated projections 11, 21, may be generally flexible and may be made from or may comprise a resilient material that may be flexible to allow slight deformation and resilient so as to return to its original shape after deformation. In preferred embodiments, elongated projections 11, 21, may be made from or comprise a flexible material such as natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), or any other flexible material including combinations of materials. In preferred embodiments, each elongated projection 11 in the first plurality of elongated projections 10 and each elongated projection 21 in the second plurality of elongated projections 20 may comprise a resilient material.

Each elongated projection 11 in the first plurality of elongated projections 10 may be separated from an adjacent elongated projection 11 by a space 12 so that each elongated projection 11 may be spaced apart from its adjacent elongated projection(s) 11. In preferred embodiments, a space 12 may comprise an elongated space or channel of between 0.1 to 1.0 inches in width (shown by W1 in FIG. 2), and more preferably an elongated space or channel of between 0.1 to 0.7 inches in width. Likewise, each elongated projection 21 in the second plurality of elongated projections 20 may be separated from an adjacent elongated projection 21 by a space 22 so that each elongated projection 21 may be spaced apart from its adjacent elongated projection(s) 21. In preferred embodiments, a space 22 may comprise an elongated space or channel of between 0.1 to 1.0 inches in width (shown by W2 in FIG. 2), and more preferably an elongated space or channel of between 0.1 to 0.7 inches in width.

In some embodiments, the elongated projections 11 in the first plurality of elongated projections 10 may be uniformly spaced apart, such that all the spaces 12 between the elongated projections 11 may be substantially the same size (all W1 measurements are substantially the same size). In some embodiments, the elongated projections 21 in the second plurality of elongated projections 20 may be uniformly spaced apart, such that all the spaces 22 between the elongated projections 21 may be substantially the same size (all W2 measurements are substantially the same size). In further embodiments, all the spaces 12 between the elongated projections 11 of the first plurality of elongated projections 10 may be substantially the same size as all the spaces 22 between the elongated projections 21 of the second plurality of elongated projections 20 (all W1 and W2 measurements are substantially the same size) as perhaps best shown in FIG. 2.

In some embodiments, the elongated projections 11 in the first plurality of elongated projections 10 may be arranged in a first linear array 13. In some embodiments, the elongated projections 21 in the second plurality of elongated projections 20 may be arranged in a second linear array 23. In some embodiments, a linear array 13, 23, may be straight linear in shape, such that all elongated projections 11, 21, in the linear array 13, 23, may substantially be aligned in a straight line (e.g., a straight row). For example, all elongated projections 11 of a first plurality of elongated projections 10 may be arranged in a first linear array 13 such that all the all elongated projections 11 are within a straight line, optionally the straight line having a width of less than 0.1 inches. In some embodiments, the elongated projections 11 in the first plurality of elongated projections 10 may be arranged in a first linear array 13, the elongated projections 21 in the second plurality of elongated projections 20 may be arranged in a second linear array 23, and the first linear array 13 and the second linear array 23 may be substantially parallel to each other when the apparatus 100 is in the first position 91.

In some embodiments, a linear array 13, 23, may be curved linear in shape, such that all elongated projections 11, 21, in the linear array 13, 23, may substantially be aligned in a curved line (e.g., a curved row). For example, all elongated projections 11 of a first plurality of elongated projections 10 may be arranged in a first linear array 13 such that all the all elongated projections 11 are within a curved line, optionally the curved line having a width of less than 0.1 inches, and the curved line forming an arc of a circle. In some embodiments, a linear array 13, 23, that may be curved linear in shape may be curved from a range of 180-degree angle to a 360-degree angle. A linear array 13, 23, that may be curved linear in shape may allow the user additional customization for creating different shaped crocheted items, e.g., hats that are created using a continuous stitch.

In some embodiments, each elongated projection 11 of the first plurality of elongated projections 10 may be proximate (within 0.1 to 0.5 inches) to the second plurality of elongated projections 20 when the apparatus 100 is in the first position 91, and one or more elongated projections 11 of the first plurality of elongated projections 10 may be moved out of being proximate the second plurality of elongated projections 20 when the apparatus 100 is in the second position 92. For example, the first plurality of elongated projections 10 and second plurality of elongated projections 20 may be movably coupled together via a hinge 71 positioned proximate to one end of the first plurality of elongated projections 10 and positioned proximate to one end of the second plurality of elongated projections 20 so that the opposing ends may open away from each other in the second position 92 while the ends of the first 10 and second 20 plurality of elongated projections that are proximate to the hinge 71 may remain proximate to each other in both positions 91, 92.

In some embodiments, each elongated projection 11 of the first plurality of elongated projections 10 may be proximate to the second plurality of elongated projections 20 when the apparatus 100 is in the first position 91, and each elongated projections 11 of the first plurality of elongated projections 10 may be moved out of being proximate with the second plurality of elongated projections 20 when the apparatus 100 is in the second position 92. For example, the first plurality of elongated projections 10 and second plurality of elongated projections 20 may be removably coupled together, such as via threaded fasteners, magnets, or other removable coupling device, so that the first plurality of elongated projections 10 and second plurality of elongated projections 20 may be separate from each other when the apparatus 100 is in the second position 92. As another example, the apparatus 100 may comprise a hinge 71 that may be positioned below the first 10 and second 20 plurality of elongated projections so that when the apparatus 100 is in the second position 92, all the elongated projections 11 of the first plurality of elongated projections 10 may be moved out of being proximate with the second plurality of elongated projections 20 when the apparatus 100 is in the second position 92.

In some embodiments, the first plurality of elongated projections 10 may be coupled to a first panel 51 and the second plurality of elongated projections 20 may be coupled to a second panel 52. Generally, panels 51, 52, may hold and provide structure for the working product 201 as it is moved down and away from the pluralities of elongated projections 10, 20. The panels 51, 52, may replace or function as the user's hand which holds the crocheted working product 201. For example, the panels 51, 52, may comprise two smooth, flat panels that hold the crocheted working product 201 between the panels 51, 52.

In some embodiments, the apparatus 100 may comprise a first panel 51, and the first plurality of elongated projections 10 may be coupled to the first panel 51. The elongated projections 11 of the first plurality of elongated projections 10 may be coupled to the first panel 51 so that the elongated height dimension of the elongated projections 11 extend away from and above the first panel 51. In further embodiments, the apparatus 100 may comprise a second panel 52, and the second plurality of elongated projections 20 may be coupled to the second panel 52. The elongated projections 21 of the second plurality of elongated projections 20 may be coupled to the second panel 52 so that the elongated height dimension of the elongated projections 21 extend away from and above the second panel 52. By moving all or portions of a first panel 51 to be proximate to a second panel 52, all or portions each of the plurality of elongated projections 10, 20, coupled to each panel 51, 52, may likewise be moved proximate to each other when the apparatus 100 is in the first position 91. By moving all or portions of a first panel 51 out of being proximate to a second panel 52, all or portions each of the plurality of elongated projections 10, 20, coupled to each panel 51, 52, may likewise be moved out of being proximate to each other when the apparatus 100 is in the second position 92.

A panel 51, 52, may be configured in any size and shape. In preferred embodiments, a first panel 51 may comprise an elongated shape that is elongated between a first end 55 and a second end 56 to support the elongated projections 11 of the first plurality of elongated projections 10 being arranged in a first linear array 13 which preferably may extend between the first end 55 and second end 56. In preferred embodiments, a second panel 52 may comprise an elongated shape that is elongated between a first end 57 and a second end 58 to support the elongated projections 21 in the second plurality of elongated projections 20 being arranged in a second linear array 23 which preferably may extend between the first end 57 and second end 58.

In some embodiments, the first panel 51 may be relatively closer, such as by being proximate (within 0.1 to 0.5 inches), to the second panel 52 when the apparatus 100 is in the first position 91, and the first panel 51 may be relatively farther from the second panel 52 when the apparatus 100 is in the second position 92. For example, the first panel 51 and second panel 52 may be removably coupled together, such as via threaded fasteners, magnets, or other removable coupling apparatus 100, so that the first panel 51 and second panel 52 may be separate from each other when the apparatus 100 is in the second position 92. As another example, the apparatus 100 may comprise a hinge 71 that may be coupled to the panels 51, 52, below the first 10 and second 20 plurality of elongated projections so that when the apparatus 100 is in the second position 92, the upper portions of the panels 51, 52, that are proximate to the first 10 and second 20 pluralities of elongated projections may be moved out of being proximate with each other when the apparatus 100 is in the second position 92.

In some embodiments, a portion of the first panel 51 may be relatively closer to the second panel 52 when the apparatus 100 is in the first position 91, and the portion of the first panel 51 may be relatively farther from the second panel 52 when the apparatus 100 is in the second position 92. For example, the first panel 51 and second panel 52 may be movably coupled together via a hinge 71 positioned proximate to the first ends 55, 57, of the panels 51, 52, so that the opposing second ends 56, 58, of the panels 51, 52, may open away from each other in the second position 92 while the first ends 55, 57, that are proximate to the hinge 71 may remain proximate to each other in both positions 91, 92.

A panel 51, 52, may comprise one or more work surfaces 53, 54, which may preferably contact or be positioned proximate to the working product 201 (rows of stitches of flexible filament 200) when the working product 201 is positioned between the first panel 51 and the second panel 52 when the apparatus 100 is in the first position 91. The first work surface(s) 53 of the first panel 51 may be positioned below the first plurality of elongated projections 10, and the second work surface(s) 54 of the second panel 52 may be positioned below the second plurality of elongated projections 20. In some embodiments, a first panel 51 may comprise one or more, such as a plurality of, first work surfaces 53, and a second panel 52 may comprise one or more, such as a plurality of, second work surfaces 54. When the apparatus 100 is in the first position 91, the first panel 51 and its first work surface(s) 53 may be positioned proximate (within 0.1 to 0.5 inches) to the second panel 52 and its second work surface(s) 54. When the apparatus 100 is in the second position 92, the first panel 51 and one or more, such as all, of its first work surface(s) 53 may be moved away from the second panel 52 and one or more, such as all, of its second work surface(s) 54 so that one or more, such as all, of the first work surface(s) 53 may not be positioned proximate to one or more, such as all, of its second work surface(s) 54.

Work surfaces 53, 54, may be configured in any size and shape. In preferred embodiments, a work surface 53, 54, may comprise a flat or planar shape. Optionally, the first work surface(s) 53 of the first panel 51 may be approximately parallel to the second work surface(s) 54 of the second panel 52 when the apparatus 100 is in the first position 91. In further embodiments, a work surface 53, 54, may comprise a curved, such as a convex curved shape so that the work surface 53, 54, may be curved towards an adjacent work surface 53, 54, when the apparatus 100 is in the first position 91.

When in the first position 91, the panels 51, 52, and the first 10 and second 20 pluralities of elongated projections may be separated by a product channel 19. In preferred embodiments, one or more opposing work surfaces 53, 54, and/or one or more opposing movable surfaces 63, 64, may be separated by the product channel 19. Generally, a product channel 19 may provide a space or channel that the working product 201 may move down and through as the working product 201 is moved down and away from the pluralities of elongated projections 10, 20. In some embodiments, the width or spacing of the panels 51, 52, from each other, and therefore the width or spacing of the product channel 19, may be adjustable. For example, the apparatus 100 may comprise one set screw on each end of a panel 51, 52, that is not attached to a stand 80. These set screws and one or more springs may hold a movable segment which may be moved by the set screws to allow the user to increase or decrease the spacing between the panels 51, 52, from each other, and therefore the width or spacing of the product channel 19 to be increased or decreased to accommodate for various thicknesses of flexible filament 200 e.g., yarn.

In some embodiments, the apparatus 100 may comprise one or more hinges 71 which may enable the apparatus 100 to be moved into and between the first position 91 and the second position 92. In preferred embodiments, the apparatus 100 may comprise a hinge 71 that may movably couple the first panel 51 and the second panel 52 together. Optionally, the apparatus 100 may comprise a hinge 71 that may movably couple the first end 55 of the first panel 51 to the first end 57 of the second panel 52. Optionally, the apparatus 100 may comprise a hinge 71 that may be coupled to the first panel 51 between the first end 55 and the second end 56 and the hinge 71 may also be coupled to the second panel 52 between the first end 57 and the second end 58. Optionally, a hinge 71 may be coupled to two or more other elements of the apparatus 100 and may enable apparatus 100 to be moved into and between the first position 91 and the second position 92.

A hinge 71 may comprise a butt hinge, butterfly hinge, flush hinge, barrel hinge, concealed hinge, continuous hinge, T-hinge, strap hinge, double-acting hinge, Soss hinge, a flexible material hinge, or any other type or style of hinge or pivotal joining method that allows all or portions of the panels 51, 52, and all or portions of their respective plurality of elongated projections 10, 20, to be pivoted towards and away from each other. In further embodiments, a hinge 71 may comprise any type of hinge known in the art, including so-called "living" hinges, which typically comprise a linear, relatively flexible area between two relatively more rigid components, such as a line of thin plastic between thicker plastic portions, as is well known in the art.

In some embodiments, the apparatus 100 may comprise a locking mechanism 72 which may removably lock the apparatus 100 in the first position 91 and/or in the second position 92. In some embodiments, the apparatus 100 may comprise a locking mechanism 72 that may removably lock the first panel 51 and the second panel 52 together in the first position 91. For example, a locking mechanism 72 may comprise a lock base 73 and two or more lock bars 74 that may be made from a substantially rigid material, such as metal, hard plastic, etc. The first panel 51 may comprise one or more lock channels 75 that may extend through the first panel 51, preferably between the first 55 and second 56 ends, and the second panel 52 may comprise one or more lock channels 76 that may extend through the second panel 52, preferably between the first 57 and second 58 ends. The apparatus 100 may be locked in the first position 91 by inserting one lock bar 74 into a lock channel 75 of the first panel 51 and by inserting another lock bar 74 into a lock channel 76 of second panel 52, and the lock base 73 may prevent the two lock bars 74, and therefore the panels 51, 52, and their respective pluralities of elongated projections 10, 20, from being moved out of the first position 91. Optionally, the lock bars 74 may be coupled to the lock base 73 and the lock bars 74 may be removably inserted into the lock channels 75, 76. Optionally, the lock bars 74 may be coupled within the lock channels 75, 76, and the lock bars 74 may be removably inserted into the lock base 73.

In some embodiments, the apparatus 100 may comprise one or more advancers 61, 62. For example, the apparatus 100 may comprise a first advancer 61 that may be coupled to the first panel 51, and/or a second advancer 62 that may be coupled to the second panel 52. Generally, an advancer 61, 62, may facilitate the movement of the working product 201 down between the panels 51, 52, and away from the pluralities of elongated projections 10, 20, as rows of stitches are completed so that a new row of stitches of working product 201 may be created using the pluralities of elongated projections 10, 20. An advancer 61, 62 may be used to allow the user to position the working product 201 to be aligned with the pluralities of elongated projections 10, 20. For example, as each row of crocheted or working product 201 is completed the working row is no longer aligned with the pluralities of elongated projections 10, 20, and the advancer 61, 62, may be used to allow the user to position the working product 201 up or down between the panels 51, 52, to provide proper alignment.

Each advancer 61, 62 may comprise one or more movable surfaces 63, 64, which may be level with, and more preferably raised above (extending towards the opposing panel 51, 52, when the apparatus 100 is in the first position 91) the work surface(s) 53, 54, of the panel 51, 52, that the advancer 61, 62, is coupled to. Preferably, a movable surface 63, 64, may be configured to rotate or otherwise move relative to a work surface 53, 54. For example, an advancer 61, 62, may comprise a roller which may revolve or rotate around an axis that may be generally parallel to the elongated length of the panels 51, 52, and/or to the elongated linear arrays 13, 23, so that the advancer 61, 62, may comprise one or more cylindrical movable surfaces 63, 64. As another example, an advancer 61, 62 may comprise a belt of flexible material, such as silicone, rubber, flexible plastic, etc., that may revolve or rotate around an axis that may be generally parallel to the elongated length of the panels 51, 52, and/or to the elongated linear arrays 13, 23, so that the movable surface 63, 64, may be formed by the outside surface of the belt-type advancer 61, 62. Preferably, a movable surface 63, 64, may comprise a flexible material, such as silicone, rubber, flexible plastic, etc., that may increase the frictional engagement of the movable surface 63, 64, with the working product 201. Optionally, a movable surface 63, 64, may be moved by a user turning a handle, wheel, knob, lever, or other mechanical user input. Optionally, a movable surface 63, 64, may be moved by a motor, such as an electric motor.

The apparatus 100 may comprise one or more guide assemblies 30, and each guide assembly 30 may comprise a guide aperture 31 that extends above both the first plurality of elongated projections 10 and the second plurality of elongated projections 20. A guide aperture 31 may be formed by a guide body 32. A guide aperture 31 may comprise an opening of any size and shape through which flexible filament 200 may move through. Optionally, a guide body 32 may form a conduit, channel, or other conducting configuration which may terminate in a guide aperture 31 through which flexible filament 200 may move through.

In some embodiments, the guide body 32 may be coupled to a guide base 33 that may be used to couple the guide assembly 30 to a panel 51, 52, and/or to couple a tensioner assembly 40 to the guide assembly 30. In some embodiments, a guide aperture 31 and guide body 32 may be removably coupled to a guide base 33, or other element of the apparatus 100. For example, guide aperture 31 and guide body 32 may be configured to function while being free standing, attached to a human body part, attached to another mount, etc. Generally, a guide assembly 30 may be used to provide guidance for the flexible filament 200 that is being directed or supplied to the pluralities of elongated projections 10, 20, to have the proper angle for the attacking needle 300. The guide assembly 30 may replace or function as the outstretched user finger that holds the yarn or other flexible filament 200 at the proper angle for the attacking needle 300.

A guide assembly 30 may be configured in any shape and size. In some embodiments, a guide assembly 30 may comprise a guide body 32 that may comprise a wire with a loop, twisted channel, or other hollow structure that may form the guide aperture 31. In further embodiments, a guide assembly 30 may comprise a guide base 33 that may comprise a rigid arm or structure that extends above the pluralities of elongated projections 10, 20, to which the guide body 32 may be coupled, the guide body 32 comprising a small loop or spiral of material to hold the yarn or other flexible filament 200. In further embodiments, the guide aperture 31 may extend above a tensioner assembly 40 so that the guide aperture 31 is relatively farther from the pluralities of elongated projections 10, 20, than the tensioner assembly 40.

In preferred embodiments, a guide assembly 30 may be removably coupled to a first panel 51 and/or to a second panel 52. In some embodiments, a guide assembly 30 may be movably coupled to a first panel 51 and/or to a second panel 52 so that the guide assembly 30 may be repositioned relative to the first panel 51 and/or to a second panel 52. For example, a first panel 51 may comprise a first elongated channel 14 and/or a second panel 52 may comprise a second elongated channel 24, and a portion of the guide base 33, such as a tongue 34, may be slidably received in the first 14 or second 24 elongated channel to movably couple the guide assembly 30 to one of the panels 51, 52, and/or one or both elongated channels 14, 24, may be open so that the tongue 34 of guide base 33 may be slid into and out of the elongated channels 14, 24, to removably couple the guide assembly 30 to one of the panels 51, 52.

In some embodiments, the apparatus 100 may comprise one or more tensioner assemblies that may be coupled, such as by being removably coupled, to an element of the apparatus 100. In preferred embodiments, a tensioner assembly 40 may be coupled to the guide base 33 of a guide assembly 30. In further embodiments, a tensioner assembly 40 may be removably coupled and/or repositionably coupled to a panel 51, 52. For example, a tensioner assembly 40 may clip in to one or more fixed holes positioned at various intervals and location along the length of a panel 51 and not necessarily restricted to being positionable along an elongated channel 14, 24. In further embodiments, a tensioner assembly 40 may be configured to function in a stand-alone fashion so that it can function without being required to be coupled to another element of the apparatus 100. For example, a tensioner assembly 40 may be configured to function while being free-standing relative to the other elements of the apparatus, to function while being attached to a human body part, to function while being coupled to another mount, etc.

Generally, a tensioner assembly 40 may be configured to control the tension of the flexible filament 200 as it moves towards and through the guide aperture 31 of the guide assembly 30 so that the flexible filament 200 is not too slack or too tight for the user to add the flexible filament 200 to the working product 201 in a series of stitches. While crocheting, the user will usually wrap the yarn or other flexible filament 200 around their fingers to control how much tension the flexible filament 200 has. Too much tension and the flexible filament 200 will pull the previous stitches apart, too little tension and the needle 300 will not be able to make the appropriate loop or pull.

A tensioner assembly 40 may be configured to receive the flexible filament 200 so that the flexible filament 200 moves between at least two elements of the tensioner assembly 40, such as between two or more filament contact surfaces 41, 42, 43. In some embodiments, and the tensioner assembly 40 may have a first filament contact surface 41, a second filament contact surface 42, and a third filament contact surface 43, and the tensioner assembly 40 may exert a resistance to the flexible filament 200 moving through the tensioner assembly 40 by exerting a resistance to the movement of the flexible filament 200 through the tensioner assembly 40.

In preferred embodiments, as the flexible filament 200 moves through the tensioner assembly 40, the flexible filament 200 may contact and move across two or more filament contact surfaces 41, 42, 43, so that the tensioner assembly 40 may impart a frictional resistance to movement of the flexible filament 200 through the tensioner assembly 40. In further preferred embodiments, the flexible filament 200 may move across (so as to contact) the first filament contact surface 41, across the second filament contact surface 42, and across the third filament contact surface 43 as the flexible filament 200 moves through the tensioner assembly 40, and the contact of the flexible filament 200 with the filament contact surfaces 41, 42, 43, may impart a frictional resistance to movement of the flexible filament 200 through the tensioner assembly 40.

The filament contact surfaces 41, 42, 43, of a tensioner assembly 40 may be configured in any shape and size. In some embodiments, a tensioner assembly 40 may comprise one or more generally cylindrical shaped rods or bars that the one or more filament contact surfaces 41, 42, 43, may be formed or disposed on. In preferred embodiments, a tensioner assembly 40 may comprise a first stabilizing rod 44, a central rod 45, and a second stabilizing rod 46, and the first filament contact surface 41 may be disposed on the first stabilizing rod 44, the second filament contact surface 42 may be disposed on the central rod 45, and the third filament contact surface 43 may be disposed on the second stabilizing rod 46. For example, a tensioner assembly 40 may comprise a first stabilizing rod 44 and a second stabilizing rod 46 that may be configured as two generally smooth cylindrical bars and one a central rod 45 preferably having a recessed channel into which the flexible filament 200 may move through so that the flexible filament 200 may wrap around a portion of the rods 44, 45, 46, in a serpentine fashion as the path for the flexible filament 200 to travel through the tensioner assembly 40.

Figure 6:
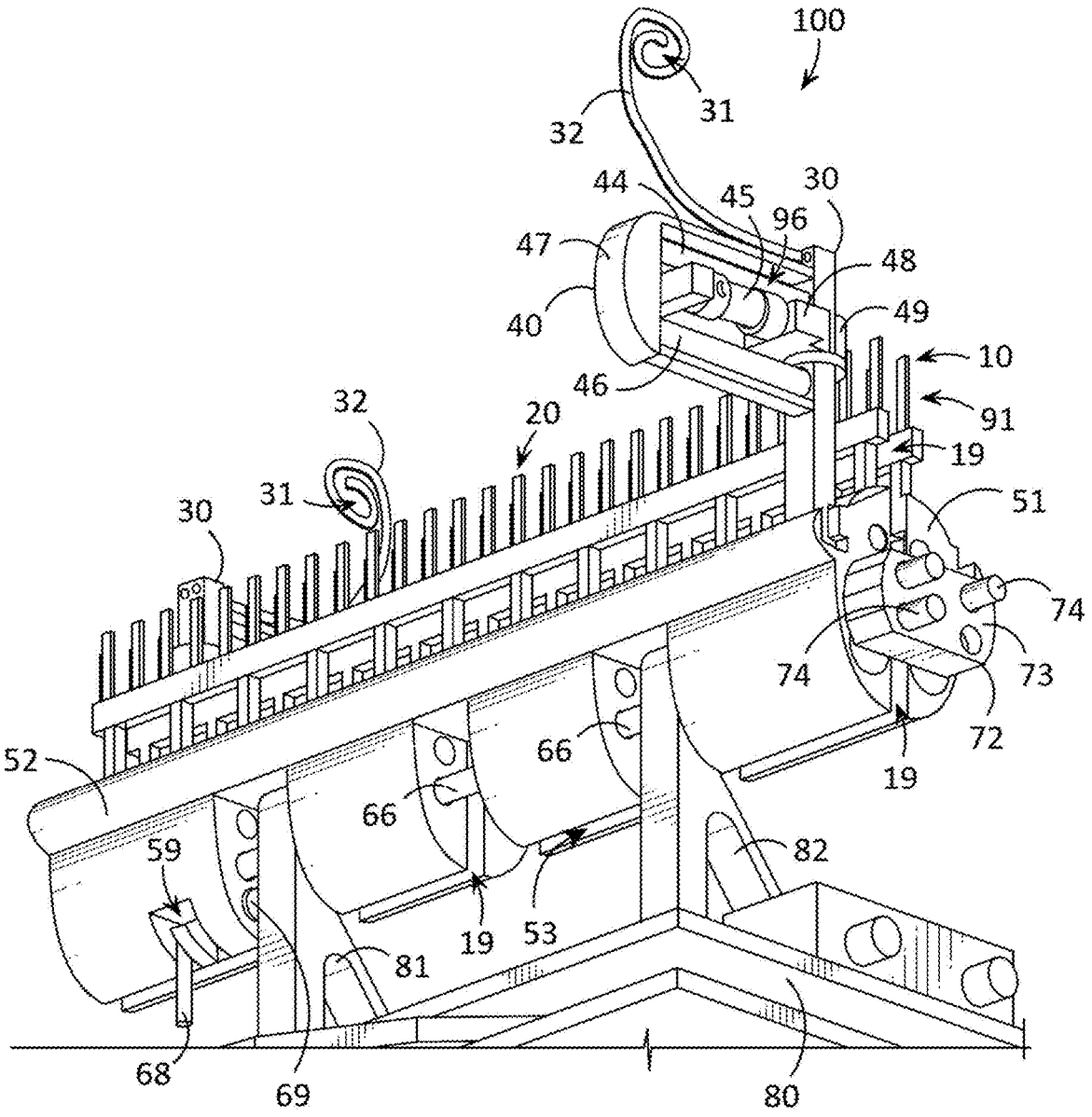
FIG. 6—FIG. 6 shows a bottom rear perspective view of an example of a crochet assistance apparatus in a first position according to various embodiments described herein.
Figure 7:
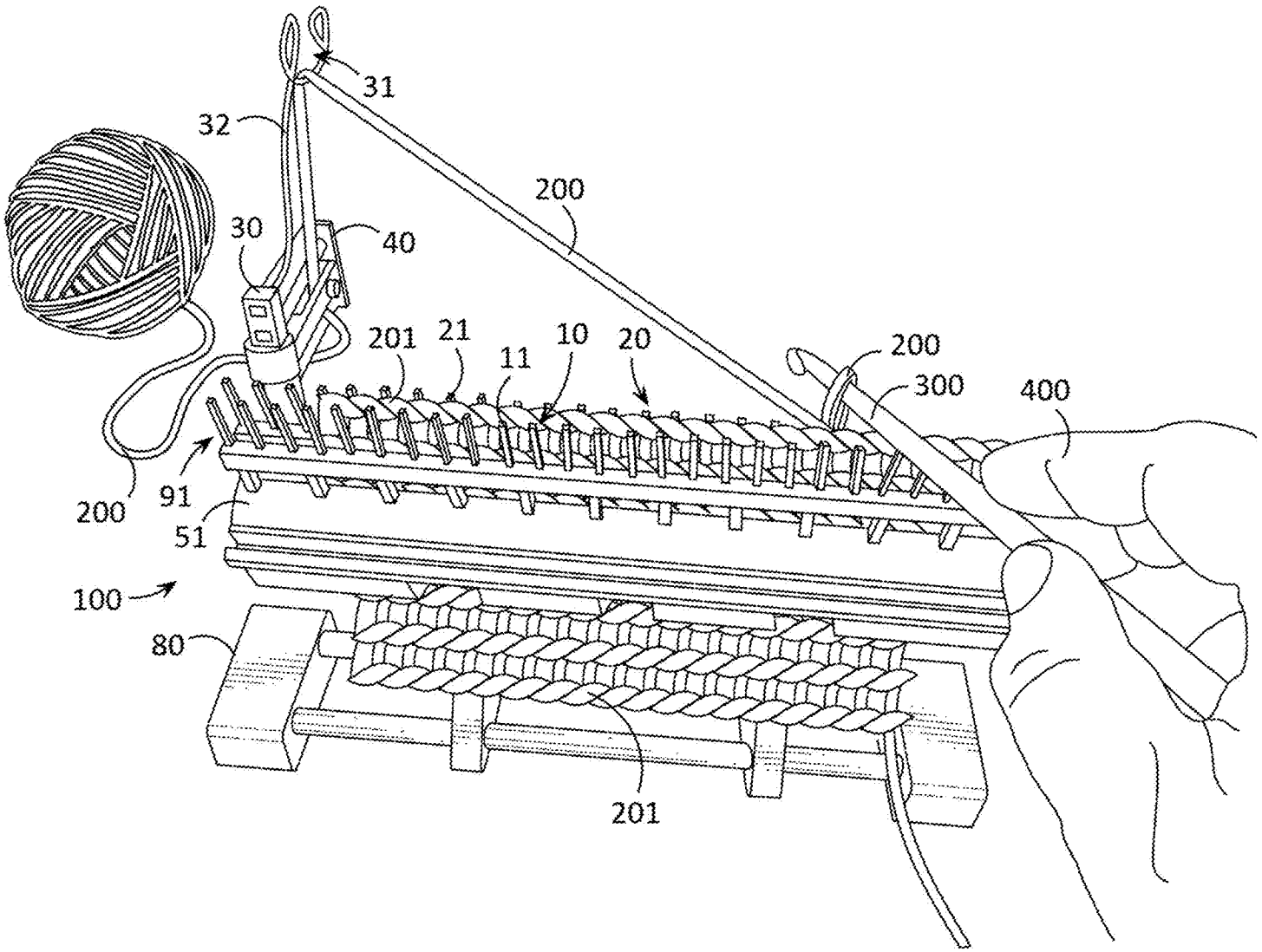
FIG. 7—FIG. 7 depicts a top front perspective view of an example of a crochet assistance apparatus being used to turn a flexible filament into a working or crocheted product according to various embodiments described herein.
Figure 8:
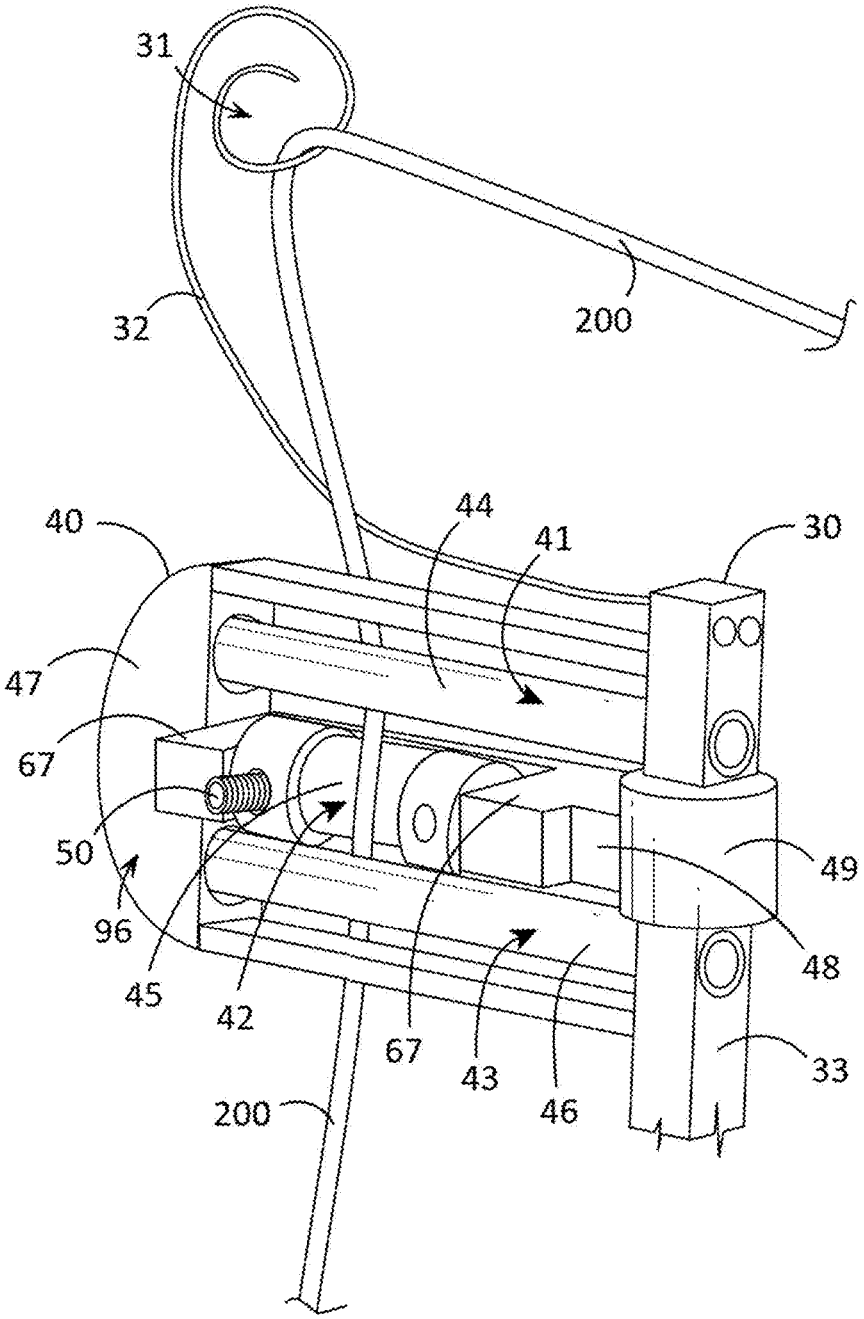
FIG. 8—FIG. 8 illustrates a partial perspective view of a guide assembly and a tensioner assembly according to various embodiments described herein.

In some embodiments, the apparatus 100 may include a central rod 45 that may be movably coupled to another element of the apparatus 100 so that all or portions of the central rod 45 may be movable relative to one or both of the stabilizing rods 44, 46. Preferably, a central rod 45 may be coupled to a tensioner swing arm 48 that may enable the central rod 45 to be movable relative to one or both of the stabilizing rods 44, 46. In some embodiments, the tensioner assembly 40 may comprise a tensioner body 47 and the stabilizing rods 44, 46, may be coupled to the tensioner body 47 and to the guide base 33. The central rod 45 may be movably coupled to the tensioner body 47 and/or movably coupled to the guide base 33 via a movable coupling 49, so that the guide base 33 may form an axis that the movable coupling 49 may pivot around (e.g., the guide base 33 may function as an axle and the movable coupling 49 may function as a bearing) to allow the tensioner swing arm 48 and the central rod 45 that is coupled to it to be movable relative to one or both of the stabilizing rods 44, 46. Preferably, the central rod 45 may be movable between an open position 95, in which only one end of the tensioner swing arm 48 may be coupled (directly or indirectly via braces 67) to the guide base 33 (FIGS. 3-5), and a closed position 96, in which one end of the tensioner swing arm 48 may be coupled to the guide base 33 and the other end of the tensioner swing arm 48 may be coupled (directly or indirectly via braces 67) to the tensioner body 47 (FIGS. 1, 6, and 8).

In some embodiments, the apparatus 100 may include a set screw 50 and spring to adjust the central rod 45 distance from the stabilizing rods 44, 46, which may be operated to adjust resistance exerted by the rods 44, 45, 46, on flexible filament 200 contacting the rods 44, 45, 46, to account for different flexible filament 200 thicknesses. For example, a set screw 50 may screw into a threaded opening of the central rod 45, and when the set screw 50 is turned the central rod 45 may move forward or backward, guided in by two braces 67 that preferably movably couple the central rod 45 to the tensioner swing arm 48, depending on the direction the set screw 50 is turned, optionally assisted by spring pressure. This forward or backward movement ability of the central rod 45 will add or remove space between the central rod 45 and the stabilizing rods 44, 46, to increase or decrease tension on the movement of the flexible filaments 200 across the filament contact surfaces 41, 42, 43.

In some embodiments, the apparatus 100 may comprise a stand 80 which may be used to support the pluralities of elongated projections 10, 20, and panels 51, 52, above surface or object, such as a table, stand, user's lap, etc. In some embodiments, a stand 80 may comprise two panel bases 81, 82, which may couple a panel 51, 52, to two stand rods 83, 84, which may in turn be coupled to two stand blocks 85, 86, that are coupled to a stand top plate 87. In preferred embodiments, a panel 51, 52, may be movably coupled to a panel base 81, 82. For example, a second panel 52 may be movably coupled to the panel bases 81, 82, via a panel axle 66, and the panel axle 66 may allow the second panel 52, and therefore the first panel 51, to pivot on the panel axle 66 (e.g., allowing the plurality of elongated projections 10, 20, to be moved towards and away from a stand top plate 87) and/or allow the second panel 52, and therefore the first panel 51, to slide a distance side to side on the panel axle 66 (e.g., allowing the ends 55, 56, 57, 58, to be moved towards and away from a panel base 81, 82).

In some embodiments, a stand top plate 87 may be movably or rotatably coupled, such as with an axle and bearing or other suitable movably coupling method, to a stand wheel 88 and/or a stand bottom plate 89. The movable or rotatable coupling may allow the stand top plate 87 to spin or rotate relative to the stand wheel 88 and/or a stand bottom plate 89. For example, a user nay rotate or spin the stand wheel 88 in order to rotate or spin the pluralities of elongated projections 10, 20, and panels 51, 52, above surface or object, such as a table, stand, user's lap, etc. that the stand bottom plate 89 may be resting on. Optionally, the stand top plate 87 and stand blocks 85, 86, may be magnetically coupled together.

In preferred embodiments, one or both panels 51, 52, may be pivotally coupled to panel bases 81, 82, such as via a panel axle 66 or other movably coupling, so that one or both panels 51, 52, may tilt so that it can lie flat so the working product 201 can be laid on top of it while the panels 51, 52, are in the second position 92. For example, a second panel 52 may be movably coupled to the panel bases 81, 82, via a panel axle 66, so that the panel axle 66 may allow the second panel 52, and therefore the first panel 51, to both pivot and slide on the panel axle 66, and the apparatus 100 may comprise a tilt arm 68 movably coupled to the bottom of one panel 51, 52, which may be movably engaged in an arm channel 59 in the other panel 51, 52. The arm channel 59 may be generally U-shaped with a first vertical portion of the arm channel 59 that is relatively closer to a panel base 81 and a second vertical portion of the arm channel 59 that is relatively farther from the panel base 81. The tilt arm 68 may have a plunger 69 which may alternate from pressing and not pressing against a portion of a panel base 81 when the tilt arm 68 is alternating positioned in different vertical portions of the arm channel 59. Optionally, on a panel base 81, 82, there may be a little guide knob or protrusion that fits into a groove or recess on a panel 51. The panels 51, 52, may be configured to slide back and forth on the panel axle 66 to alternatively position the guide knob into the groove or recess. When the panels 51, 52, are slid along the panel axle 66 in a first direction, the guide knob is positioned in the groove or recess, the panels 51, 52, may be prevented from tilting, and when panels 51, 52, are slid along the panel axle 66 in an opposite second direction, the guide knob is moved out of the groove or recess so that the panels 51, 52, may be allowed to tilt. When the tilt arm 68 is positioned in a portion of the arm channel 59 distal to the panel base 81 the plunger 69 may be moved to allow the guide knob to not be positioned in the groove or recess to allow the panels 51, 52, to tilt. When the tilt arm 68 is positioned in a portion of the arm channel 59 proximate to the panel base 81 the plunger 69 may be press against a panel base 81, 82, to prevent the panels 51, 52, from being able to slide back and forth to position and lock the guide knob in the groove or recess to prevent the panels 51, 52, from tilting.

While some exemplary shapes and sizes have been provided for elements of the apparatus 100, it should be understood to one of ordinary skill in the art that the elongated projections 11, 21, guide assembly 30, tensioner assembly 40, panels 51, 52, stand 80, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the apparatus 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A crochet assistance apparatus for supporting a flexible filament, the apparatus comprising:
   - a first plurality of elongated projections;
   - a second plurality of elongated projections, wherein the apparatus is movable between a first position and a second position, wherein each elongated projection of the first plurality of elongated projections is proximate to the second plurality of elongated projections when the apparatus is in the first position, and wherein one or more elongated projections of the first plurality of elongated projections is moved out of being proximate to the second plurality of elongated projections when the apparatus is in the second position;
   - a guide assembly, wherein the guide assembly comprises a guide aperture that extends above both the first plurality of elongated projections and the second plurality of elongated projections; and
   - a tensioner assembly configured to receive the flexible filament, the tensioner assembly having a first filament contact surface, a second filament contact surface, and a third filament contact surface, wherein the tensioner assembly exerts a resistance to the flexible filament moving through the tensioner assembly.

2. The apparatus of claim 1, wherein the tensioner assembly imparts a frictional resistance to movement of the flexible filament through the tensioner assembly.

3. The apparatus of claim 2, wherein the length of flexible filament moves across the first filament contact surface, across the second filament contact surface, and across the third filament contact surface as the flexible filament moves through the tensioner assembly.

4. The apparatus of claim 1, wherein the tensioner assembly comprises a first stabilizing rod, a central rod, and a second stabilizing rod, wherein the first filament contact surface is disposed on the first stabilizing rod, wherein the second filament contact surface is disposed on the central rod, and wherein the third filament contact surface is disposed on the second stabilizing rod.

5. The apparatus of claim 4, wherein the central rod is movable relative to one of the first stabilizing rod and the second stabilizing rod.

6. The apparatus of claim 1, wherein each elongated projection in the first plurality of elongated projections and each elongated projection in the second plurality of elongated projections comprises a resilient material.

7. The apparatus of claim 1, wherein the elongated projections in the first plurality of elongated projections are arranged in a first linear array, and wherein the elongated projections in the second plurality of elongated projections are arranged in a second linear array.

8. The apparatus of claim 7, wherein the first linear array and the second linear array are both straight linear in shape.

9. The apparatus of claim 8, wherein the first linear array and the second linear array are substantially parallel when the apparatus is in the first position.

10. The apparatus of claim 1, wherein the elongated projections in the first plurality of elongated projections are uniformly spaced apart.

11. The apparatus of claim 10, wherein the elongated projections in the second plurality of elongated projections are uniformly spaced apart.

12. The apparatus of claim 1, wherein the guide aperture extends above the tensioner assembly.

13. The apparatus of claim 1, wherein the tensioner assembly is coupled to the guide assembly.

14. The apparatus of claim 1, wherein the first plurality of elongated projections is coupled to a first panel, wherein the second plurality of elongated projections is coupled to a second panel, wherein a portion of the first panel is relatively closer to the second panel when the apparatus is in the first position, and wherein the portion of the first panel is relatively farther from the second panel when the apparatus is in the second position.

15. The apparatus of claim 14, wherein the first panel and the second panel are movably coupled together with a hinge.

16. The apparatus of claim 14, wherein the first panel and the second panel are removably coupled together via locking mechanism.

17. The apparatus of claim 14, wherein the guide assembly is removably coupled to one of the first panel or second panel.

18. The apparatus of claim 14, wherein the first panel has a first work surface and the second panel has a second work surface, wherein the first work surface is positioned below the first plurality of elongated projections, and wherein the second work surface is positioned below the second plurality of elongated projections.

19. The apparatus of claim 14, further comprising an advancer that is coupled to one of the first panel or second panel, wherein the advancer comprises a movable surface.

20. The apparatus of claim 19, wherein the movable surface is configured to rotate.

* * * * *